US005617662A

United States Patent [19]

Hwang

[11] Patent Number: 5,617,662

[45] Date of Patent: Apr. 8, 1997

[54] ORNAMENTAL STRUCTURE OF PRODUCT

[76] Inventor: Juy Hwang, 3F, No. 4, Fu-An street, Si-Chu Chen, Taipei Hsien, Taiwan

[21] Appl. No.: 563,740

[22] Filed: Nov. 28, 1995

[51] Int. Cl.[6] ..... G09F 1/12

[52] U.S. Cl. ..... 40/736; 40/732

[58] Field of Search ..... 40/700, 732, 736, 40/798, 799; 211/13, 87, 88, 86; 52/2.11; 312/224; D6/300, 509

[56] References Cited

U.S. PATENT DOCUMENTS

| | | | |
|---|---|---|---|
| 886,840 | 5/1908 | Mueller | 40/700 |
| 2,070,641 | 9/1935 | Bartels | 312/224 |
| 2,193,372 | 3/1940 | Miller | 312/224 X |
| 3,032,905 | 5/1962 | Schultz | 312/224 X |
| 3,686,782 | 8/1972 | Erickson et al. | 40/736 |
| 3,771,247 | 11/1973 | De Harak | 40/736 |
| 3,886,677 | 6/1975 | Behring et al. | 40/736 |
| 4,244,995 | 1/1981 | Gunn | 40/798 X |
| 4,393,612 | 7/1983 | Clark | 40/798 |
| 4,939,858 | 7/1990 | Dailey | 40/732 |
| 5,174,054 | 12/1992 | Politi | 40/799 X |
| 5,197,213 | 3/1993 | Borden | 40/799 X |
| 5,343,643 | 9/1994 | Cochrane | 40/732 X |

FOREIGN PATENT DOCUMENTS

| | | | |
|---|---|---|---|
| 2598541A | 11/1987 | France | 40/736 |

*Primary Examiner*—Ramon O. Ramirez
*Assistant Examiner*—Stephen S. Wentsler
*Attorney, Agent, or Firm*—Pro-Techtor International

[57] ABSTRACT

A structure of a display frame including an ornamental object and a frame enclosing the ornamental object so as to decorate the ornamental object. The frame is made from soft and thin sheet material that forms a gas-filled body.

2 Claims, 17 Drawing Sheets

ORNAMENTAL STRUCTURE OF PRODUCT

BACKGROUND OF THE INVENTION

The present invention relates particularly to a display structure that is suitable for displaying ornamental items and other objects, is easily reconfigured, and saves material cost.

Referring to FIG. 1, a conventional display rack 1 for ornamental items comprises framework and check plates made from transparent acrylic, and a mirror 2 mounted in the back plate. This enables the display rack 1 to radiate bright and wonderful colors depending on the light transmission and refraction of the transparent acrylic framework and reflection of the mirror 2.

Because the framework of the display rack is made of acrylic, the shape of its framework is thus restricted and results in a dull and simple appearance of the display rack.

If a user desires to make a further ornamental change to the framework, it will result in the increase of die production and material cost, and it will also increase the inconvenience of packing and transport. The shaping of the display rack may only be made from a thin and flat body, which is not possible to make into complicated or solid shapes, or it could be easily damaged due to collision and would result in an increase of production and material cost.

In view of this, the inventor has been engaged in research and development based on the experience of development in related products over the years and finally has developed the present invention through continuous testing and improvement.

SUMMARY OF THE INVENTION

One object of the invention is to provide an ornamental structure of a product that is easy for a user to change its appearance, and that has beautiful shaping.

Another object of the invention is to provide an ornamental structure of a product that is material cost-saving and convenient for packing and transport.

These and other objects and advantages of the present invention will become apparent to those skilled in art the after considering the following detailed specification together with the accompanying drawings.

DETAILED DESCRIPTION OF PREFERRED EMBODIMENT

Figure 1:
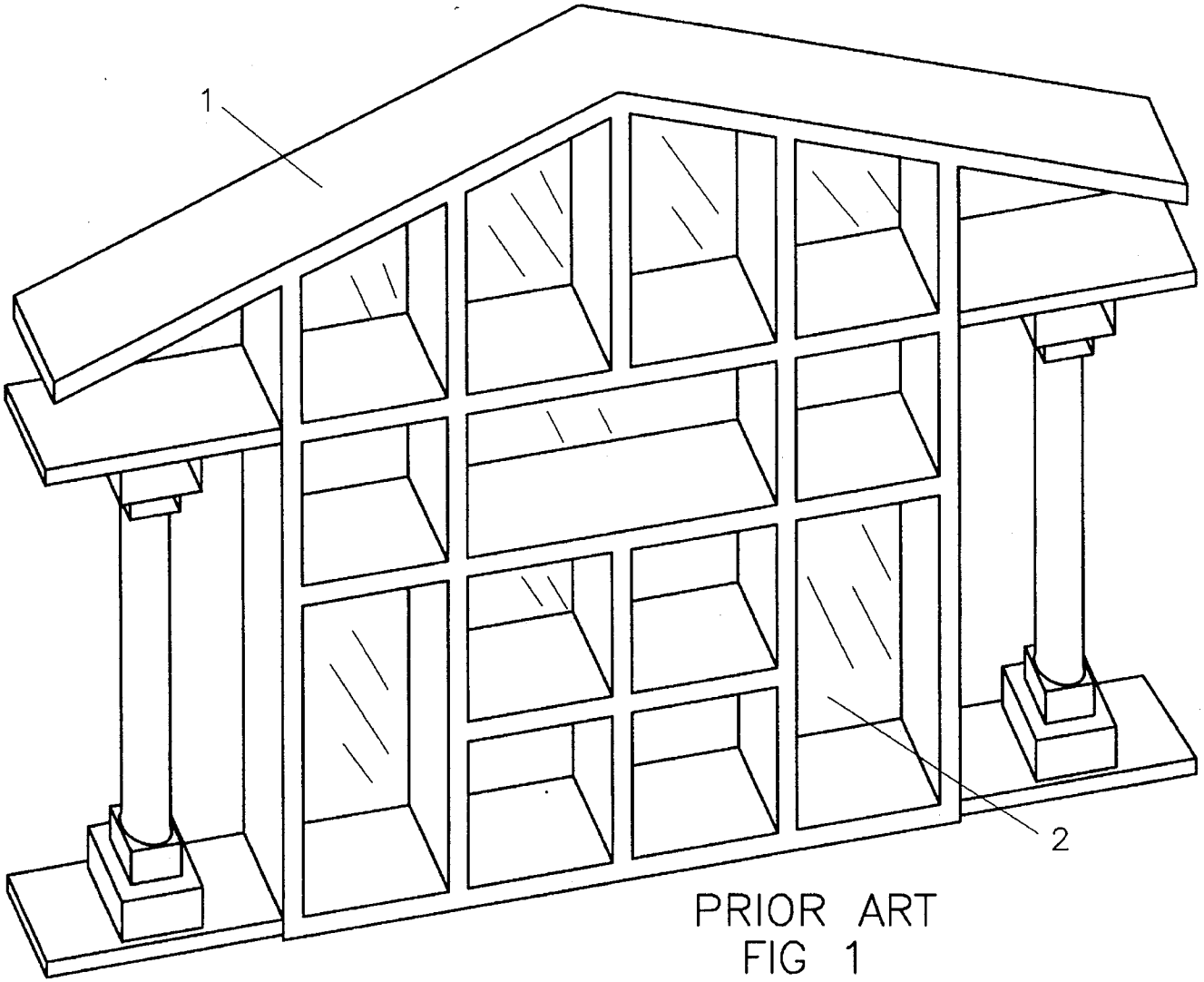
PRIOR ART FIG 1
FIG. 1 is an elevational view of the conventional display rack for ornamental items.
Figure 2:
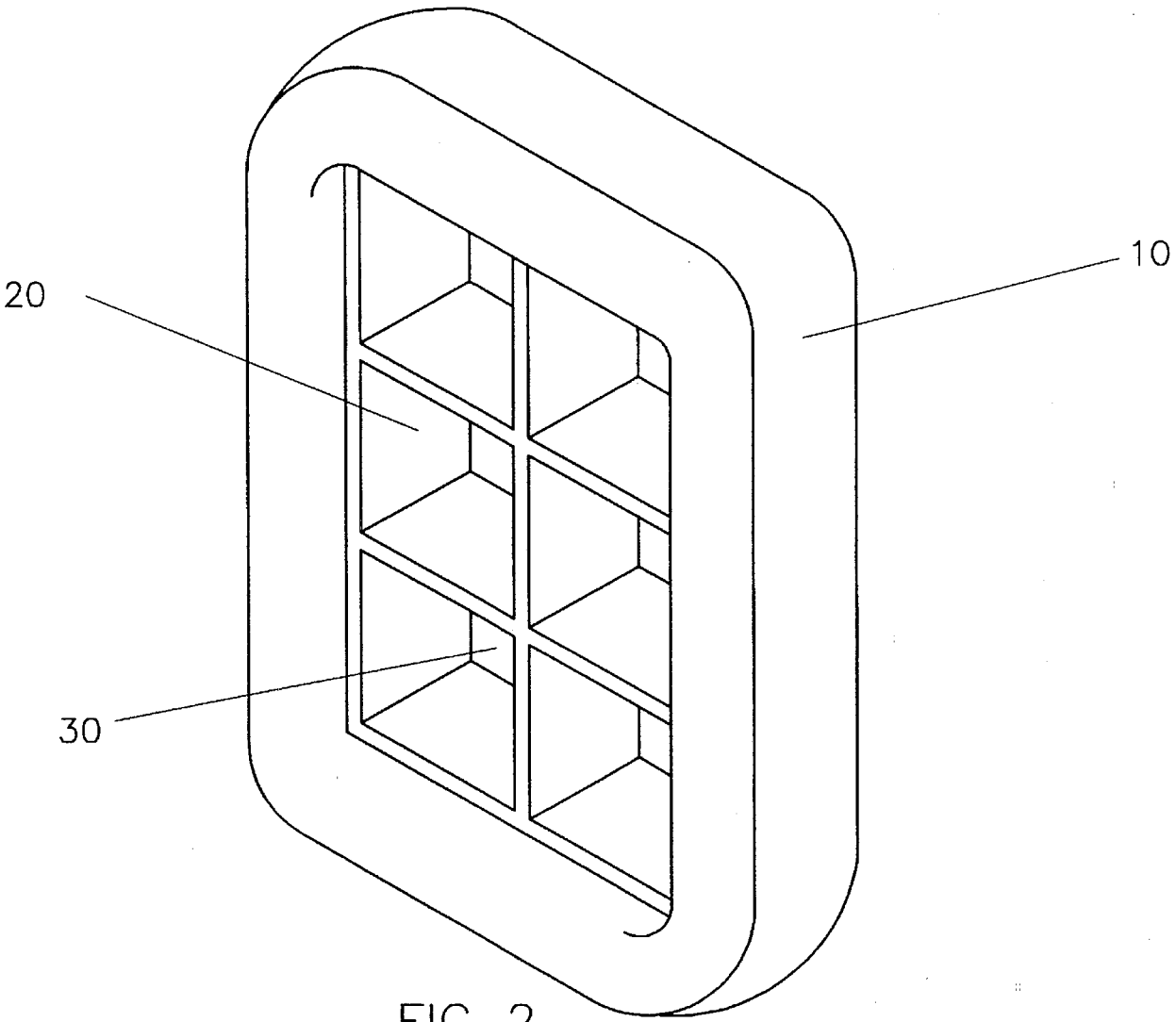
FIG. 2 is an elevational-assembly view of the ornamental structure of product according to the present invention.
Figure 3:
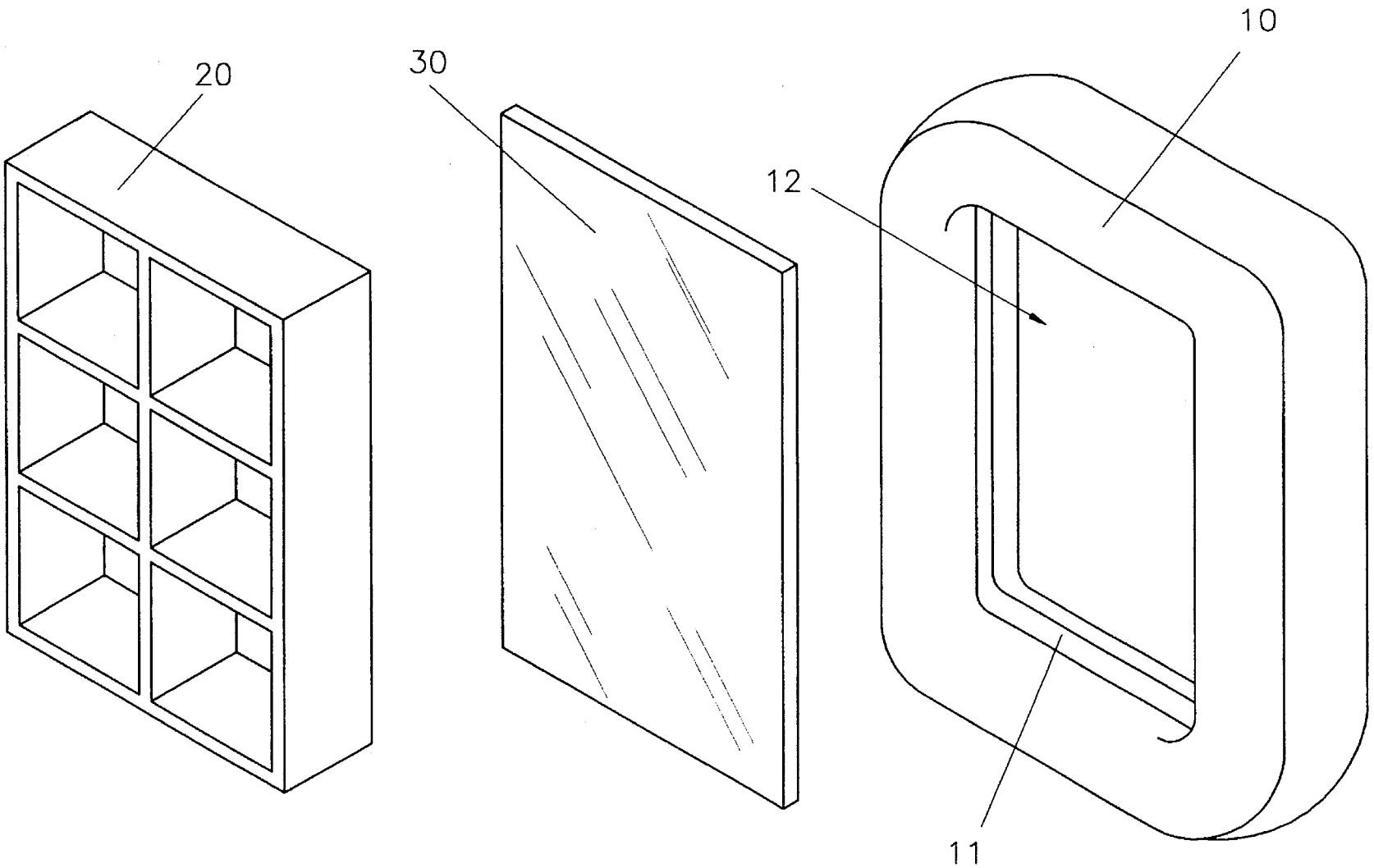
FIG. 3 is an exploded view of the structure according to the present invention.

Referring to FIGS. 2 and 3, the present invention comprises a gas-filled frame and an ornamental object mounted in the frame. The frame 10 is a gas-filled frame made from thin sheet material and has an engaging portion 12 on the central portion after it is filled with gas. The ornamental object 20 is made from acrylic, plastic, wood, hard board or other rigid material for setting in the engaging portion 12 of the frame 10. Referring to FIGS. 2 and 3, the ornamental object 20 is a display rack for ornamental items. On the rear side of the ornamental object 20 is a mirror 30 for reflecting the colors of the ornamental items on the ornamental object 20 to result in special reflections.

Figure 4A:
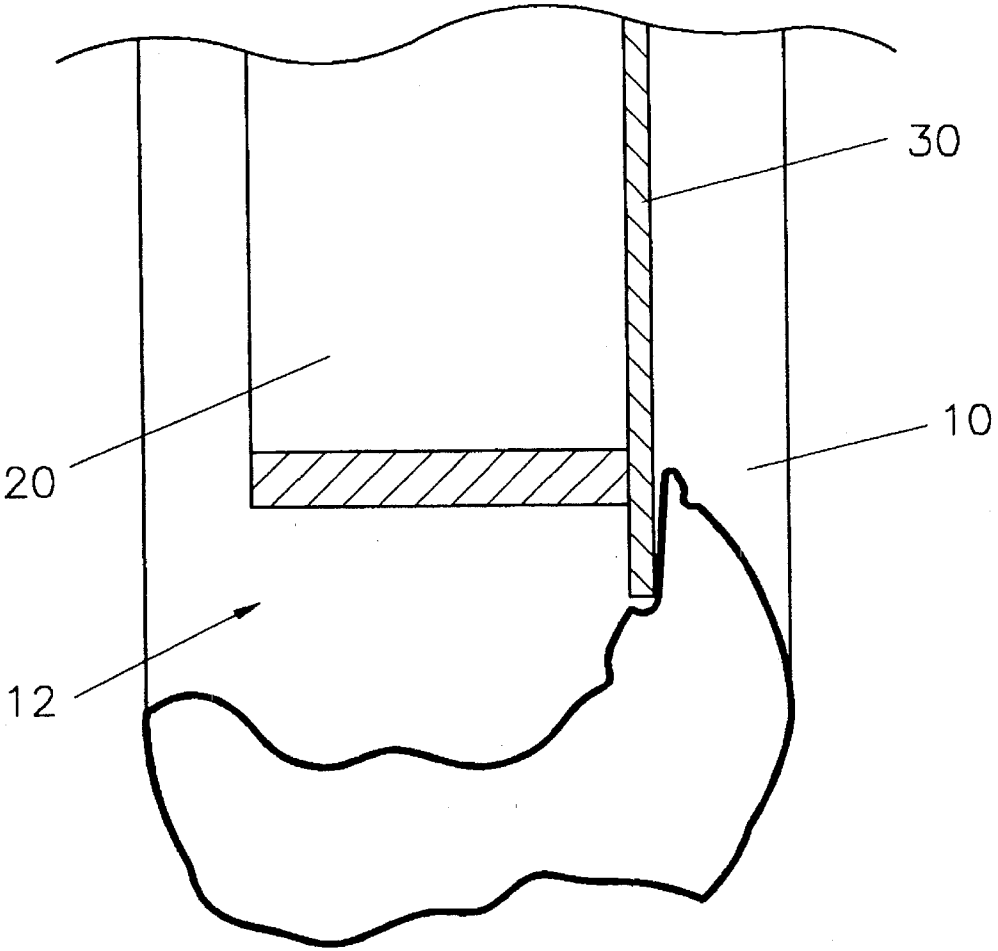
FIG. 4*a* is a cross section, illustrating the frame before it is filled with gas.
Figure 4B:
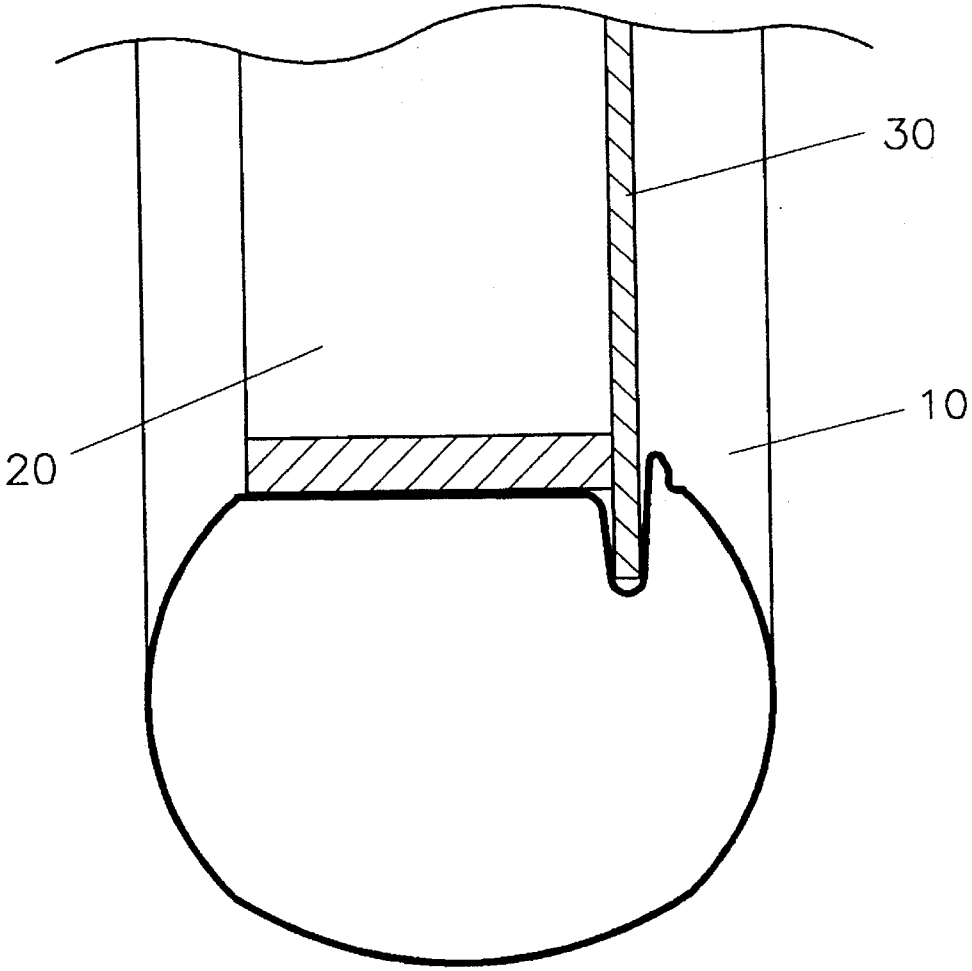
FIG. 4*b* is a cross section, illustrating the frame after it is filled with gas.

Referring to FIGS. 4*a* and 4*b*, the mirror 30 is mounted in the frame before the frame is filled with gas. After the frame 10 is filled with gas it produces a recess 11 for receiving the mirror 30 therein. The frame compresses against the edge of the mirror 30 so as to fix the mirror 30 in the frame 10.

The mirror 30 is mounted in the frame 10 with its reflective side against the rear side of the ornamental object 20. The ornamental object 20 is mounted in the frame 10 against the reflective side of the mirror 30 whereby the mirror 30 is fixed in the frame 10 and closely contacts the ornamental object 20.

The ornamental object 20 may be fixedly joined with the frame 10 or separated from the frame 10. If the frame 10 is made separate from the ornamental object 20, both may be connected by means of the elasticity of the frame 10. Referring to FIG. 3, the inner perimeter of the engaging portion 12 of the frame 10 is smaller than the outer perimeter of the ornamental object 20. After the ornamental object 20 is mounted in the frame 10, the frame 10 tightly binds the ornamental object 20 to fix it in place.

Figure 5:
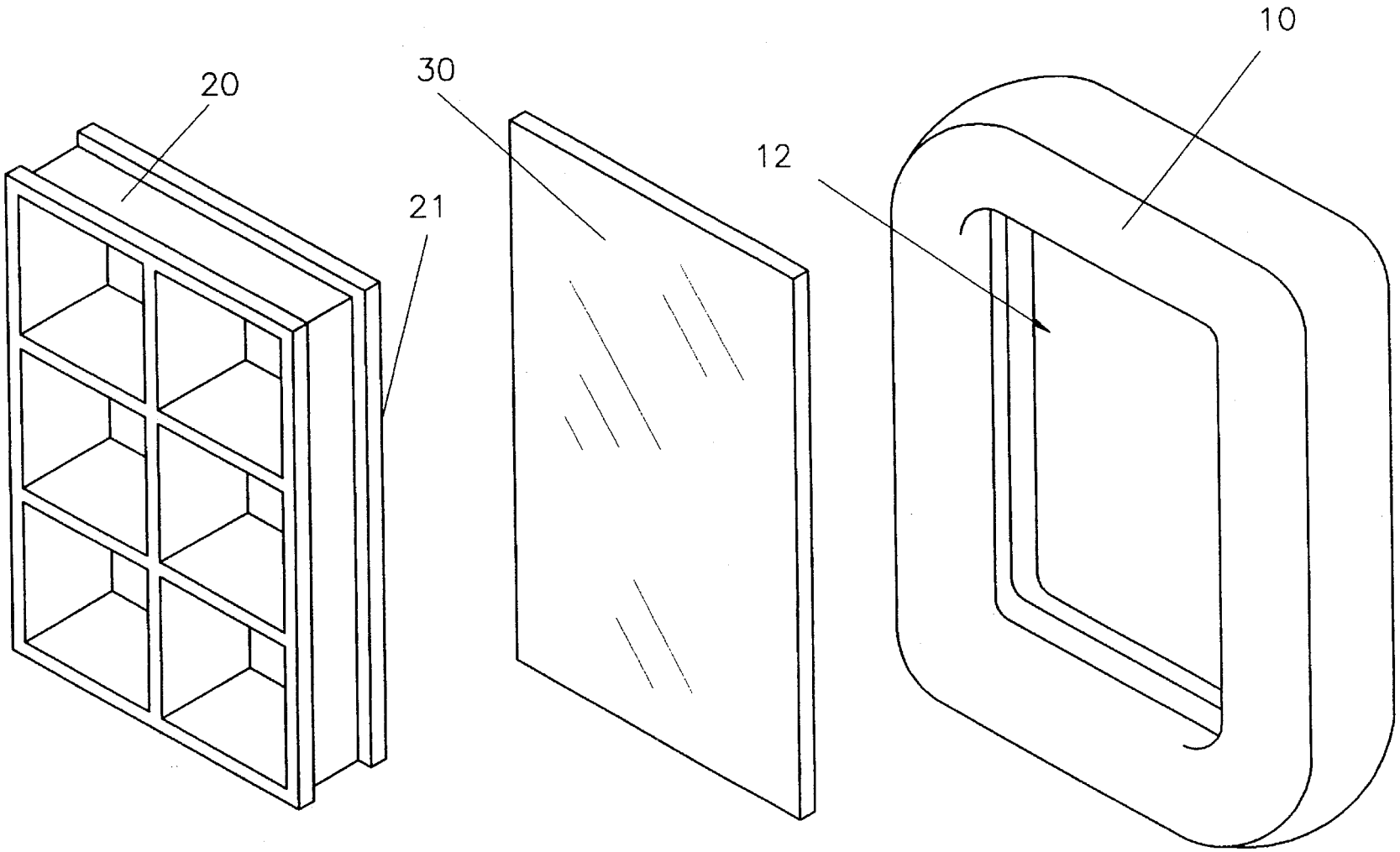
FIG. 5 is an exploded view with the side having a flange.

In addition, referring to FIG. 5, in order to stabilize the connection of the ornamental object 20 with the frame 10, the ornamental object 20 may have a flange 21 with two external projections which creates a central recess whereby after the ornamental object 20 is mounted in the frame 10, the frame 10 fills the central recess to tightly bind the ornamental object 20.

In addition, there are various changes that can be made. For instance, the frame 10 may form a plurality of engaging portions for mounting a plurality of ornamental objects 20 on the frame 10. In addition, the ornamental object 20 may be many articles.

In addition, the frame 10 may demonstrate different visual effects by means of different kinds of material or appropriate surface treatment, such as using film material with special patterns.

Figure 6:
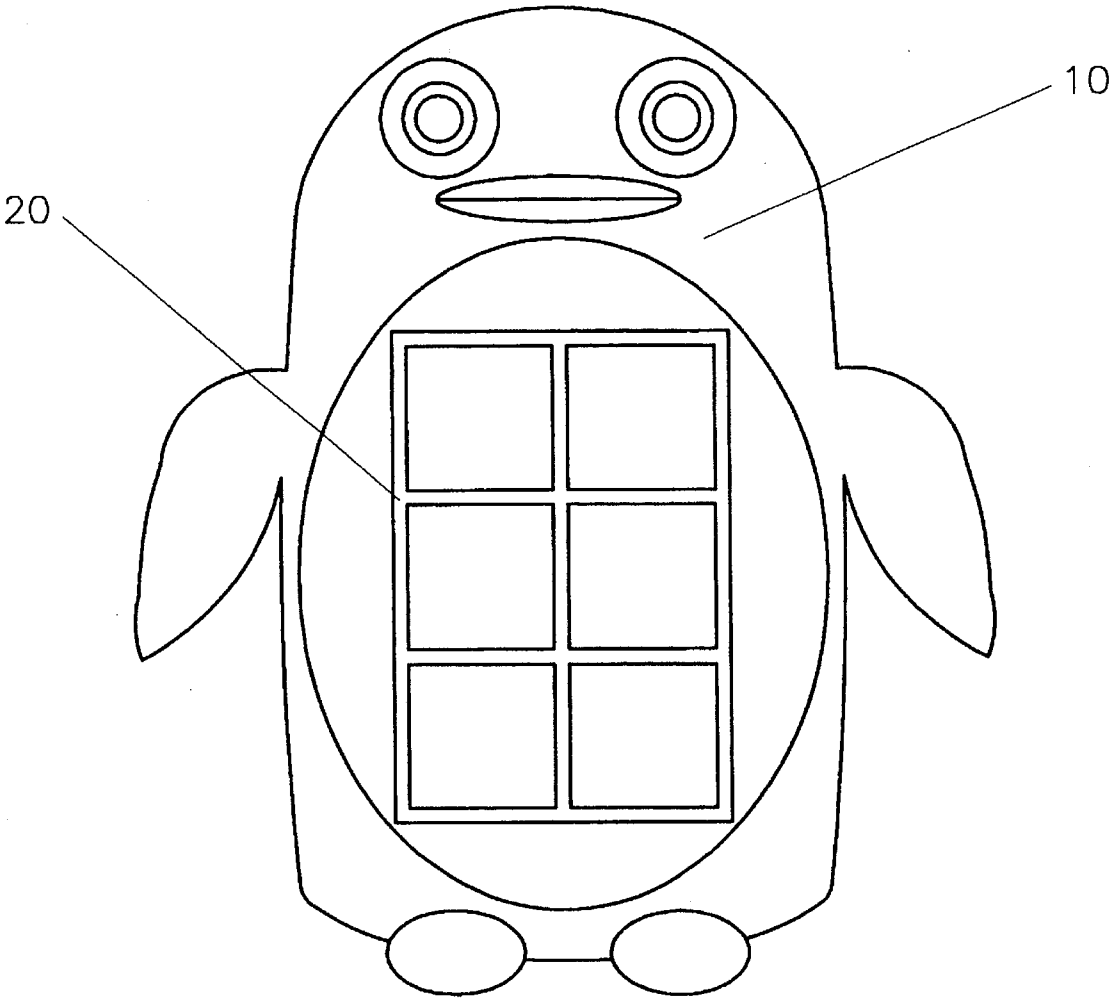
FIG. 6 is a front view of an embodiment of the present invention.
Figure 7:
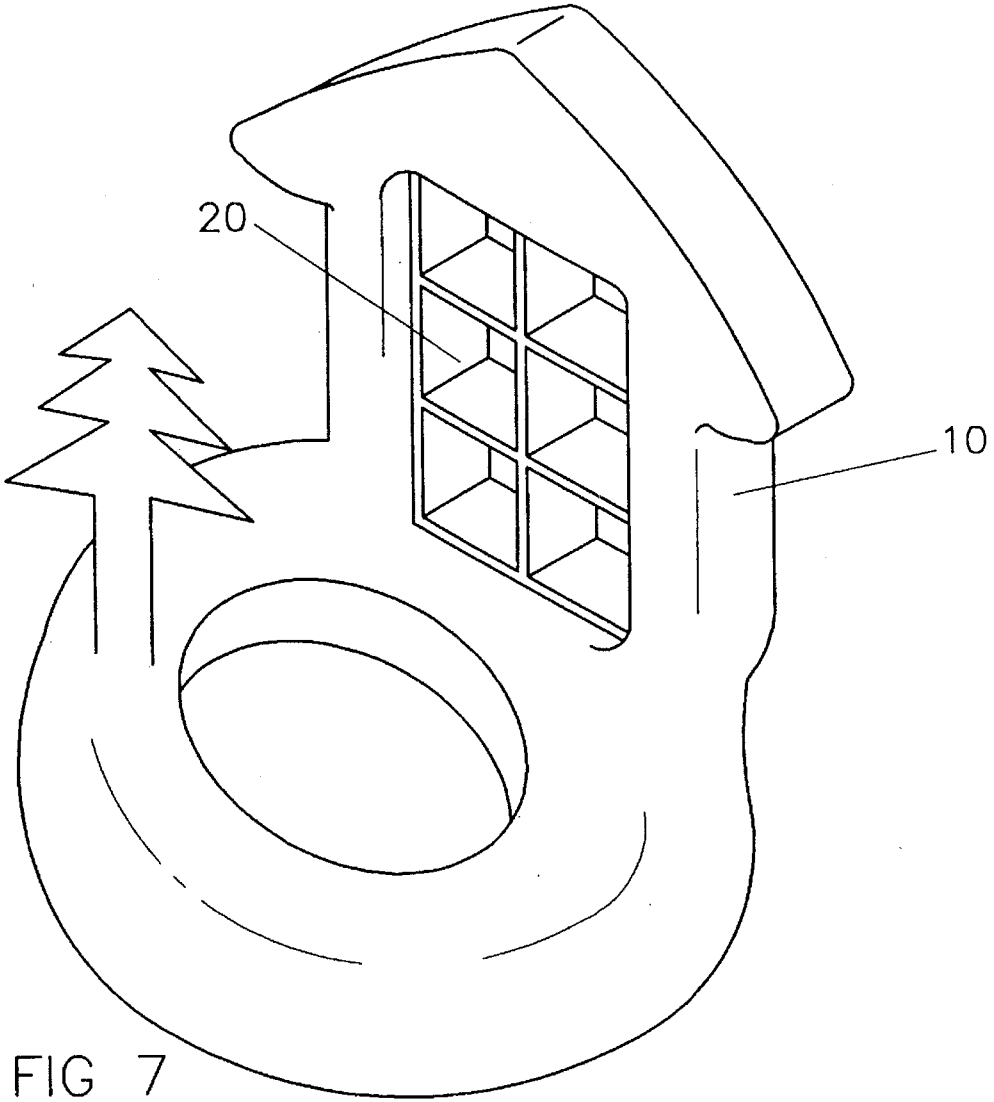
FIG. 7 is a perspective view of another embodiment of the present invention.

The frame 10 of the present invention is a gas-filled body, made from very cheap material and may be changed in shape at random. Referring to FIG. 6, the frame 10 is made into a cartoon pattern. Referring to FIG. 7, the frame 10 may be easily made into a solid shape. Therefore the shaping of the ornamental object may be changed while not increasing the material and production cost of the frame. Meanwhile the ornamental object 20 may be fixed in shape to match the frame 10 in various different shapes so as to facilitate the production of the ornamental object.

Figure 8:
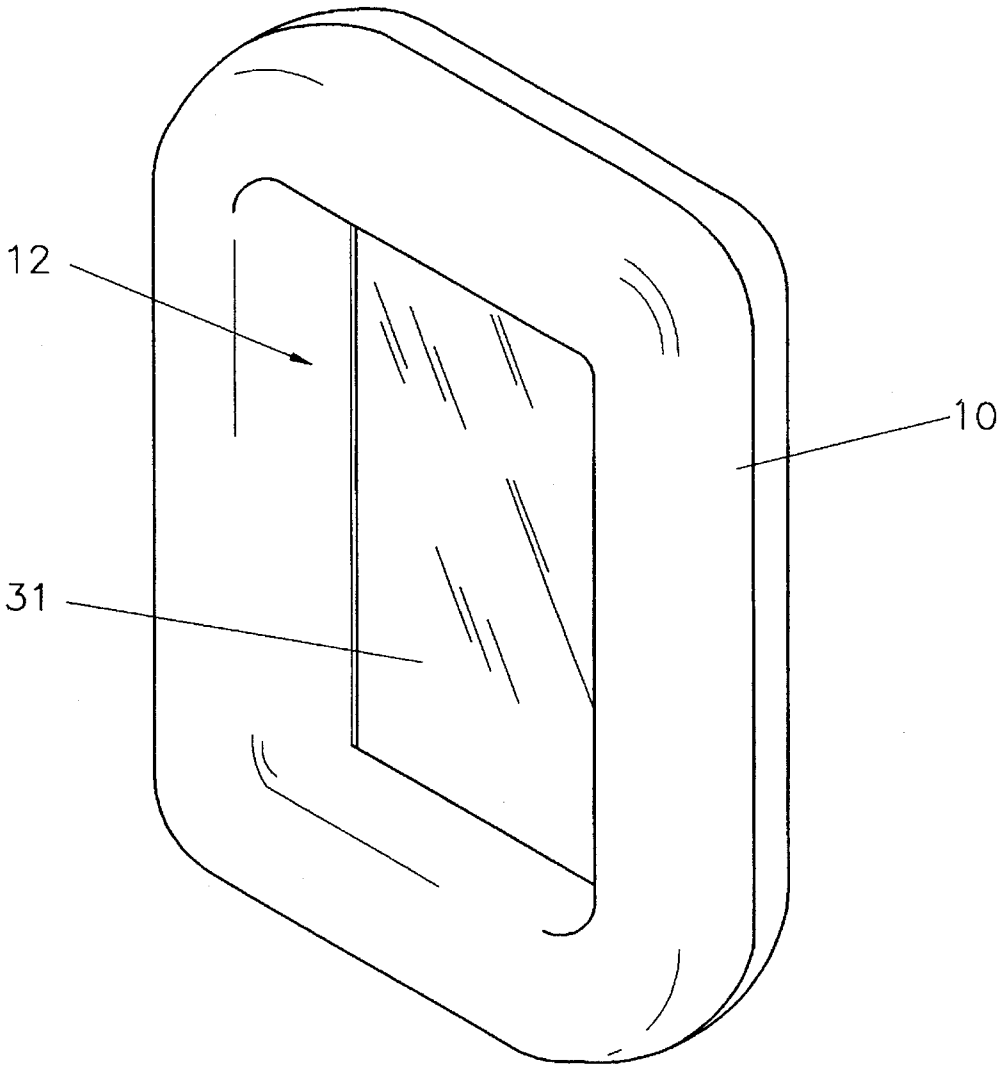
FIG. 8 is a perspective view showing the present invention made into a flat-plate body structure.
Figure 9:
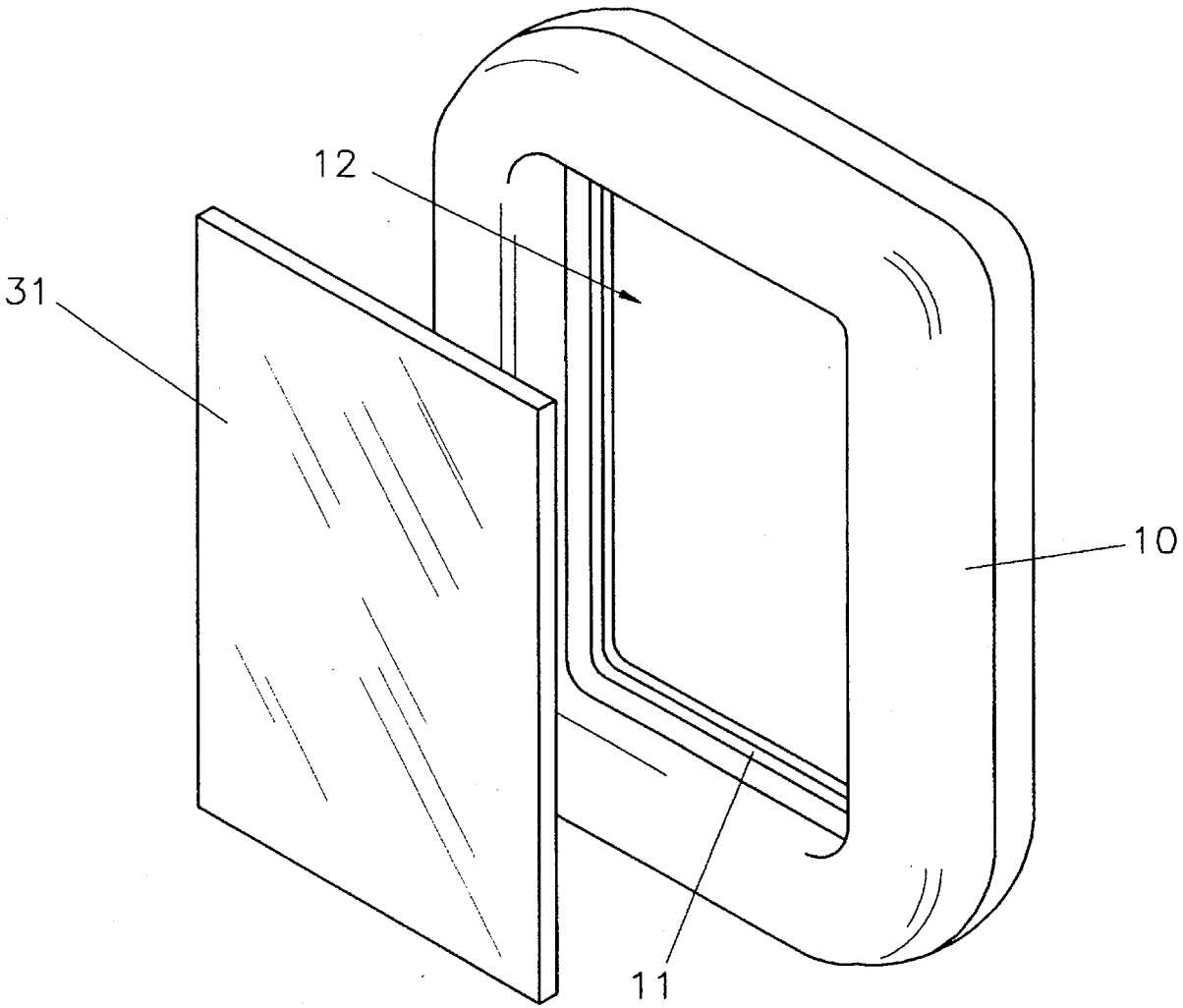
FIG. 9 is an exploded view of FIG. 8.
Figure 10:
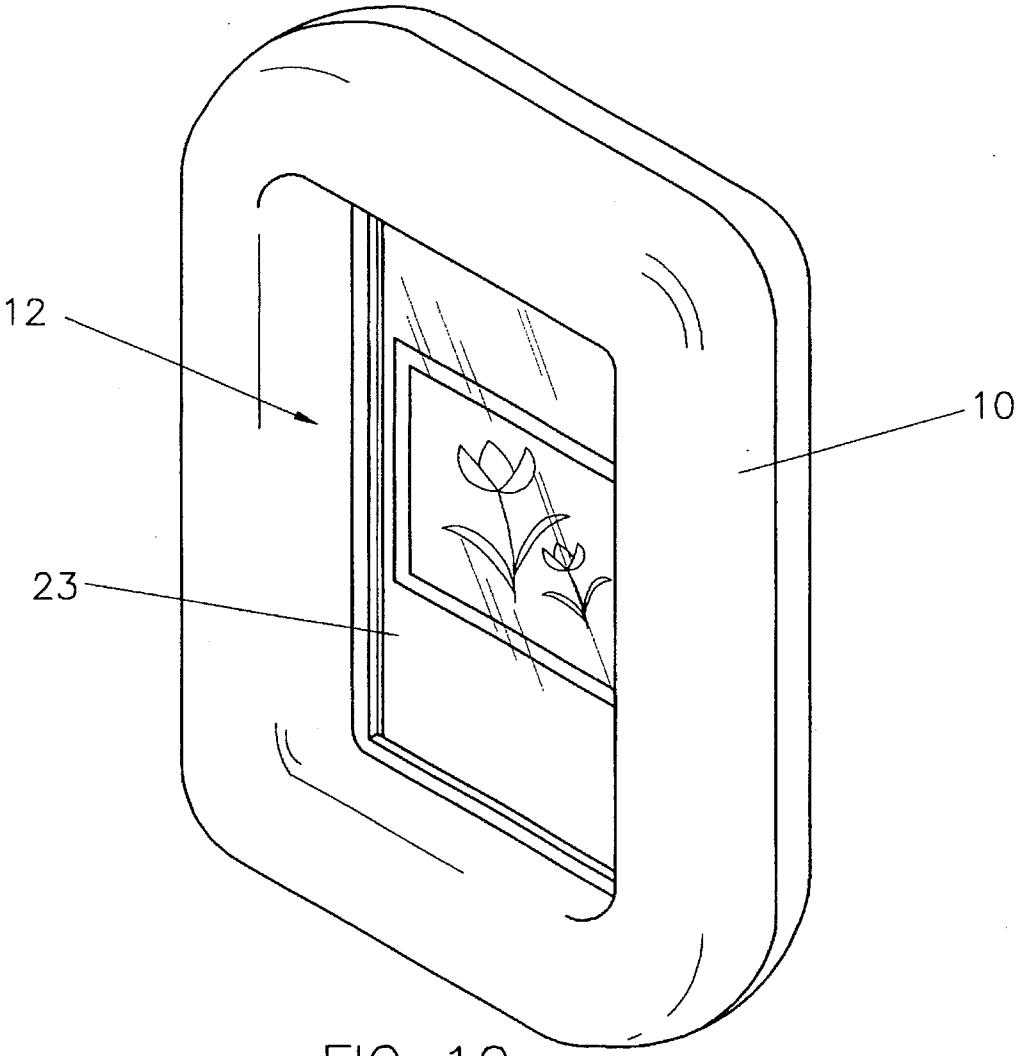
FIG. 10 is a perspective view showing the present invention used for decorating a frame.

In addition, the ornamental object 20 may be other articles, whereby the ornamental structure of the present invention may be applied to other articles such as the embodiments of FIGS. 8 and 9. The receiving portion 12 of the frame 10 has a plate body 31 therein, and the plate body 31 may be a flat-plate object such as a mirror, a signboard, note plate, bulletin, marking plate, etc. Referring to FIG. 10, the embodiment is applied to the photo frame or picture frame, and according to the embodiment a photo frame or picture frame 23 is mounted in the receiving portion 12.

Figure 11:
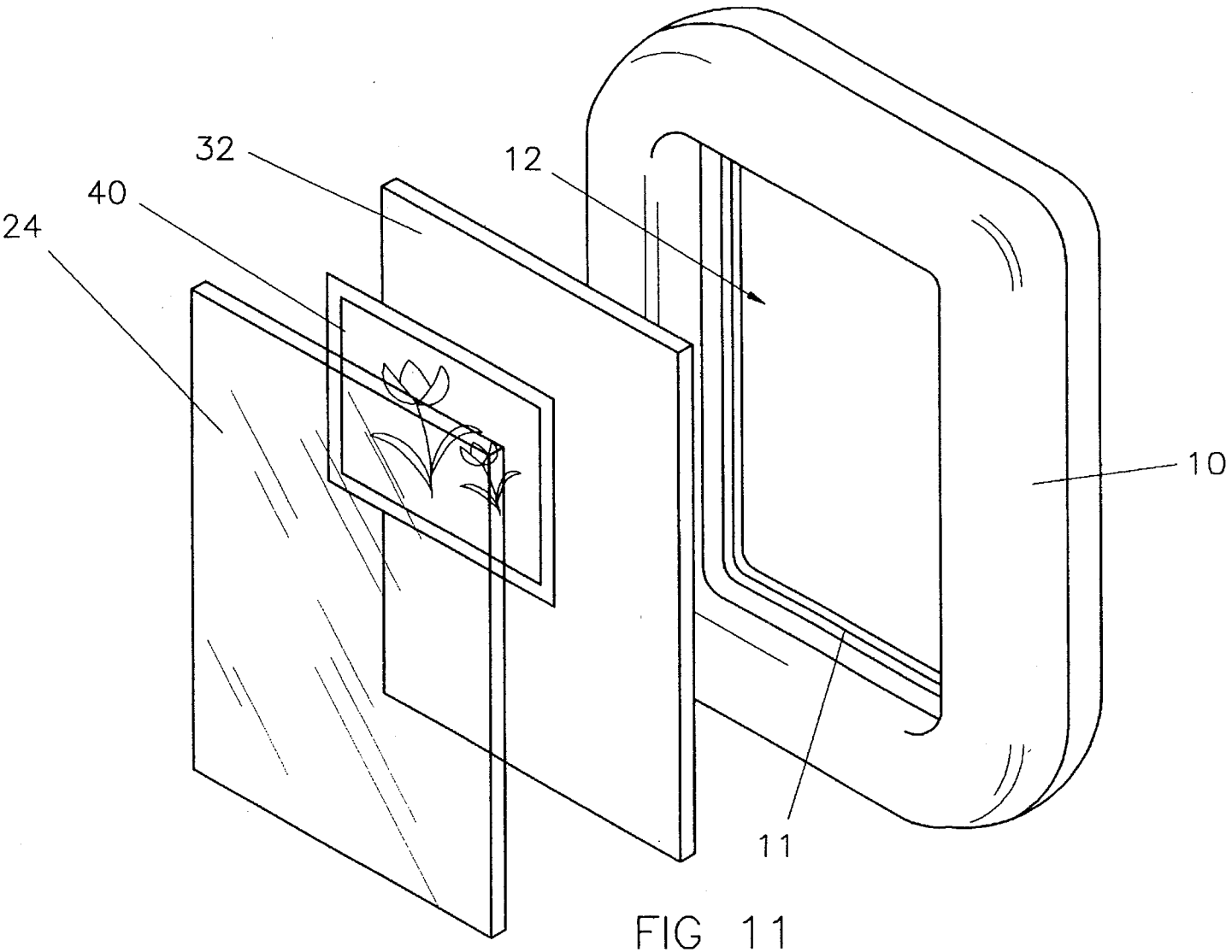
FIG. 11 is an exploded view showing the present invention as a frame structure.

Referring to FIG. 11, the embodiment of FIG. 10 may further be applied wherein it includes a back plate 32 for mounting in the receiving portion 12 of the frame 10. A transparent clamp plate 24 which is adhered to the surface of the back plate 32 for mounting in the receiving portion 12. A photo or picture 40 may be mounted between the back plate 32 to form a photo or picture frame.

Figure 12:
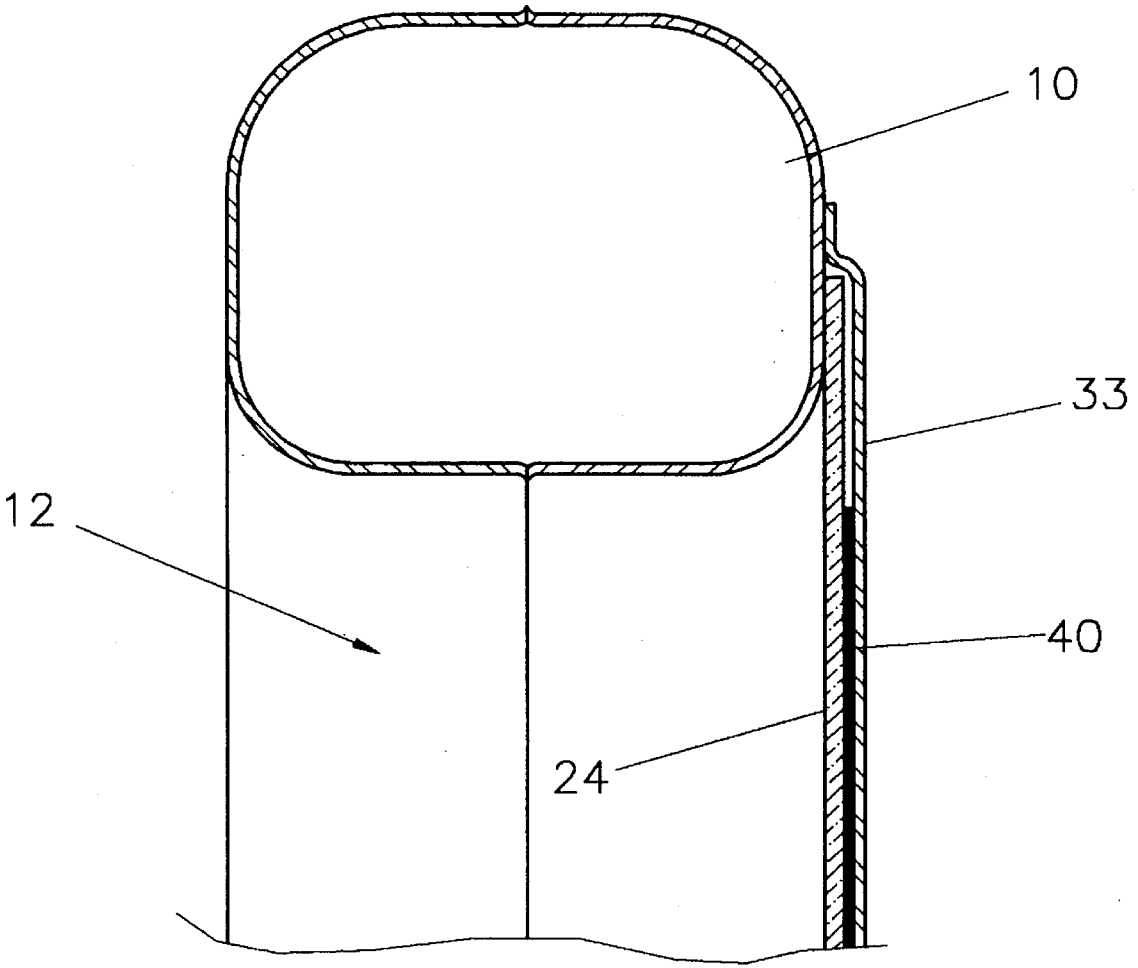
FIG. 12 is a partial cross section view showing the present invention connected to the rear side of the frame by means of adhering to the back plate.

Referring to FIG. 12, the back plate 32 of the embodiment of FIG. 11 is replaced by a thin sheet body directly adhered to the back of the frame 10. The thin-sheet back plate 33 may use plastic material to stick to the back of the frame 10 by means of sonic welding. The size of the back plate 33 is slightly larger than the size of the receiving portion 12 whereby the edge and the back of the frame 10 around the perimeter of the receiving portion 12 will lapped over to form a flat slot for the insertion of the transparent clamp plate 24, photo or picture 40.

Figure 13:
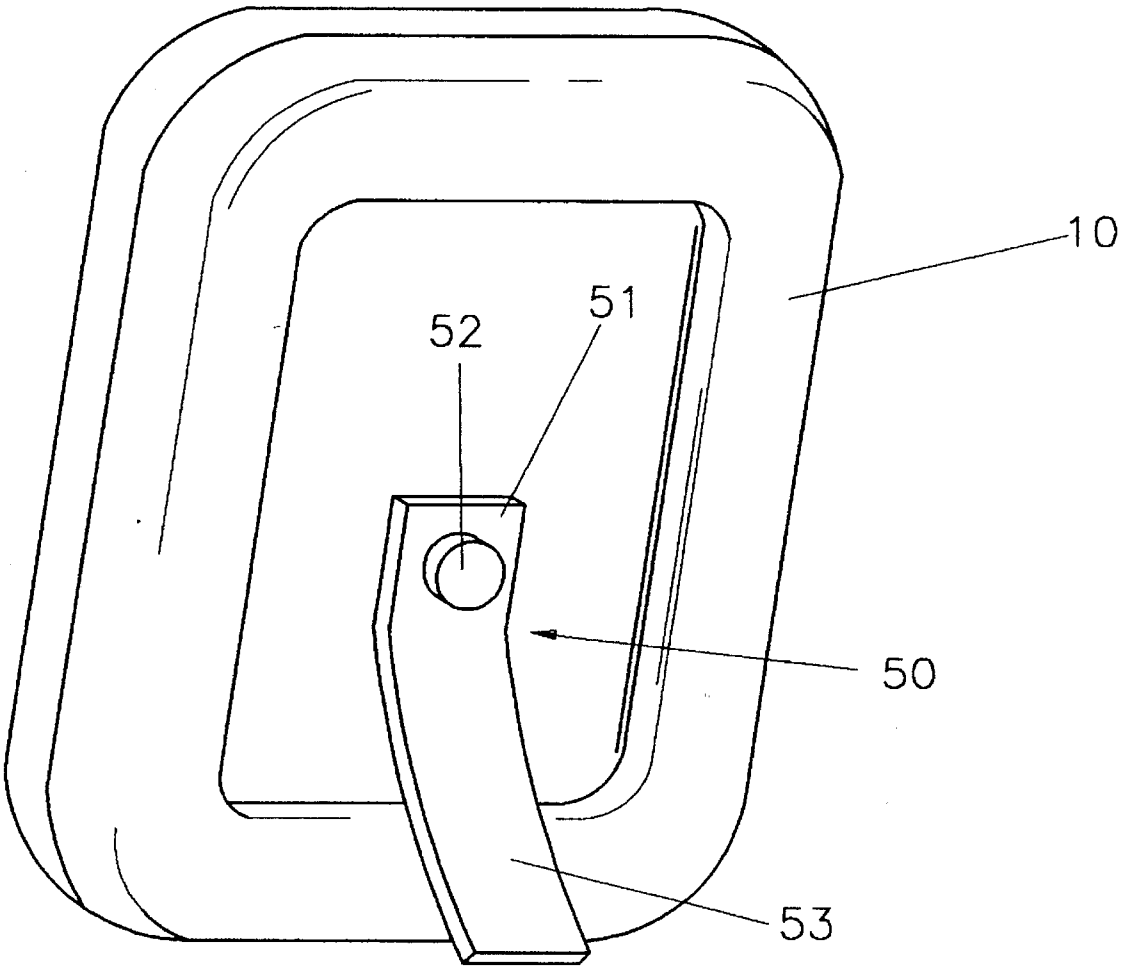
FIG. 13 is a rear view showing the present invention with a support body on the rear side of the frame.

Referring to FIG. 13, the frame of the present invention may be erected on a table and a support body 50 may be mounted on the rear of the frame 10. The support body 50 has a connection portion 51, and the connection portion 51 may be fixed to the rear side of the frame 10 by means of a fastener 52. A support portion 53 is connected to the lower side of the connection portion 51 for bracing on the table to allow the frame to be securely placed on the table.

Figure 14:
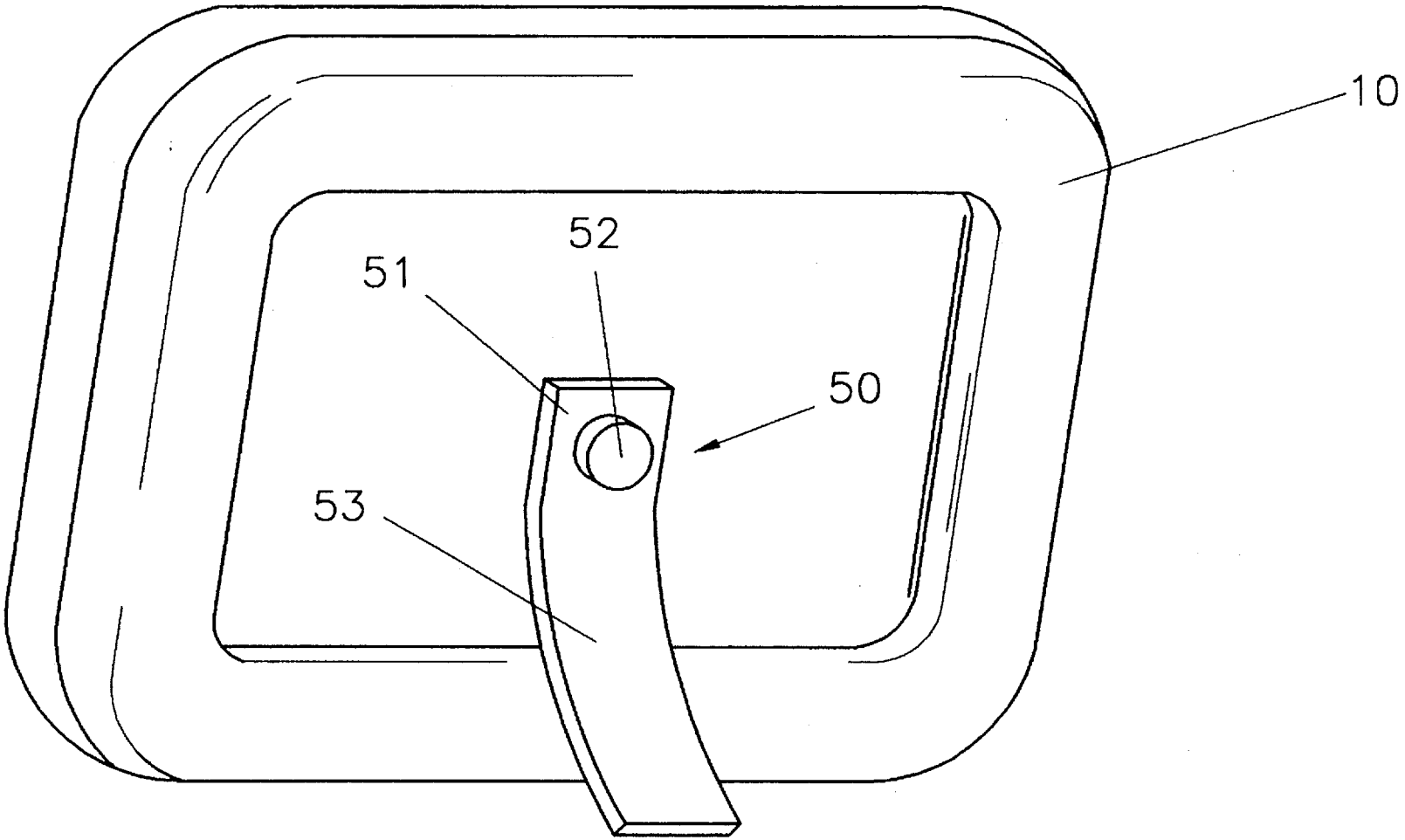
FIG. 14 is a rear view showing the embodiment of FIG. 13 placed horizontally.

Referring to FIG. 14, the connection portion 51 of the support body 50 may be rotatable about the fastener 52 whereby the angle of the support body 50 relative to the frame is adjustable.

Figure 15:
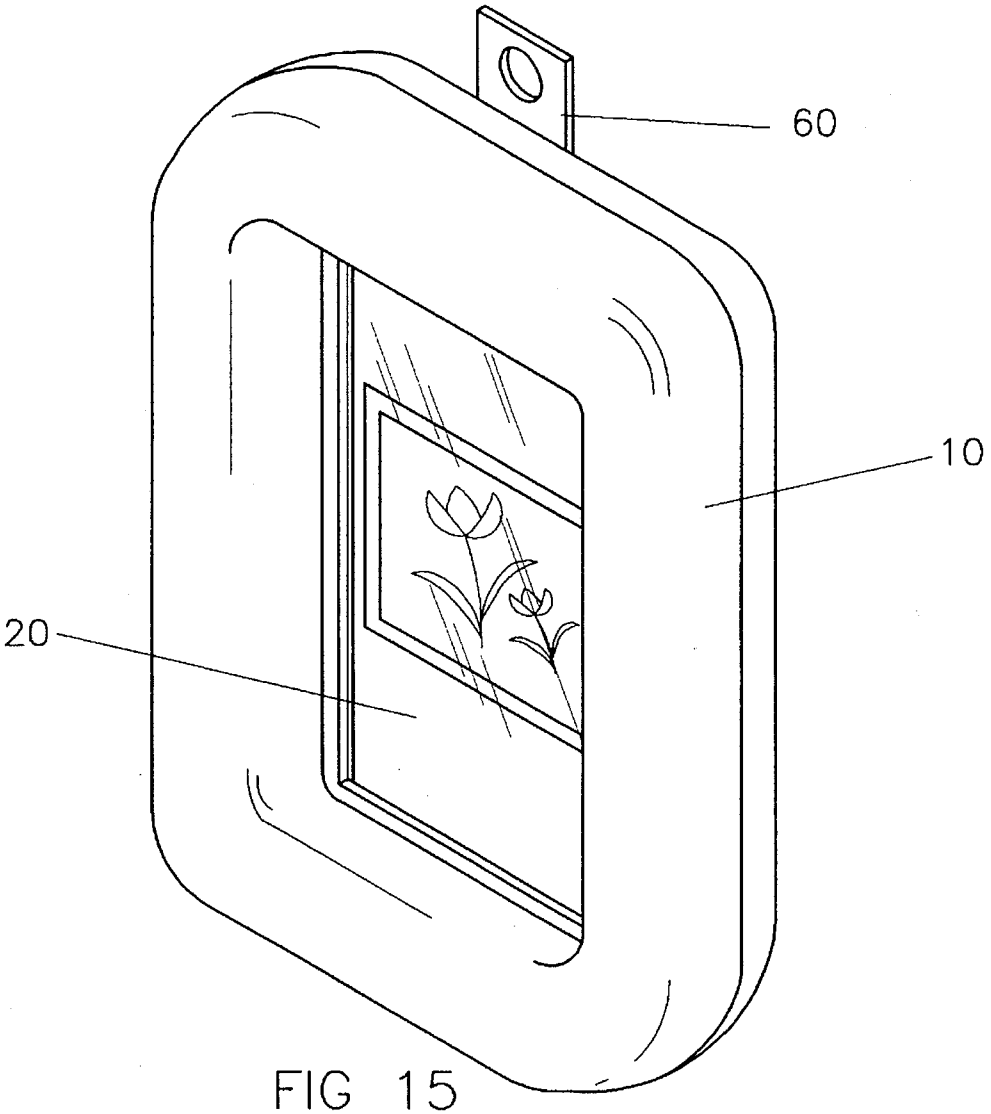
FIG. 15 is a perspective view showing the frame of the present invention with a hanger structure.

Referring to FIG. 15, the back of the frame has a hanger member 60 and it may be hung on the wall.

Figure 16:
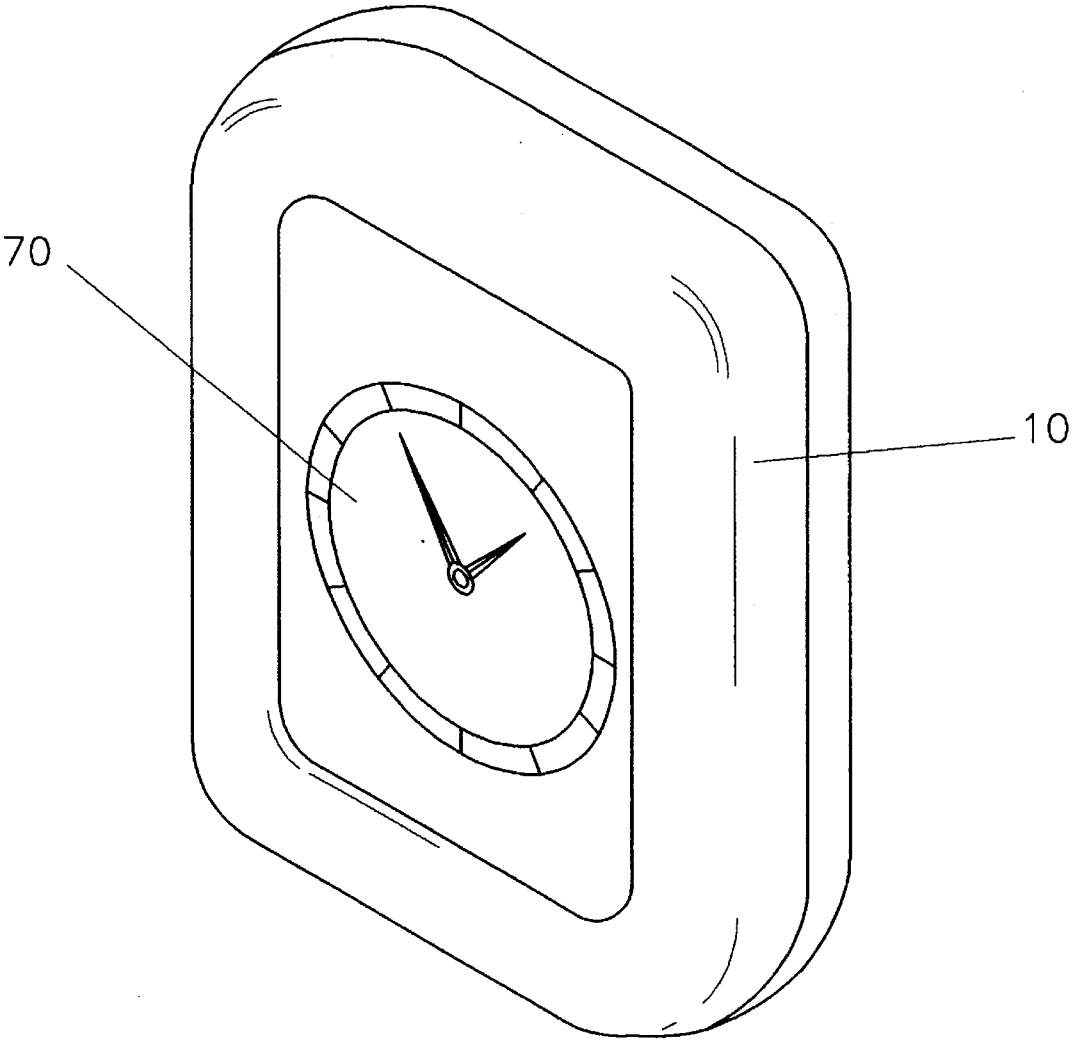
FIG. 16 is a perspective view showing the present invention used to decorate a clock.

Further, the present invention may be widely used for mounting other items and objects such as the embodiment of FIG. 16, wherein the receiving portion 12 of the frame 10 has a clock 70 therein. Another advantage of using a gas-filled body for the frame 10 of the present invention lies in that the gas in the frame 10 may be discharged for convenience of packing and transport in order to reduce the size of the frame.

I claim:

1. A structure of a display frame comprising:

a frame adapted to enclose an ornamental object, said frame is made from a soft thin-sheet material that forms a gas receiving body that expands when filled with gas and collapses when said gas is discharged, said frame forms at least one engaging portion when said frame is filled with gas, said engaging portion adaptable to said ornamental object therein, said frame adapted to be separably disconnected from said ornamental object, an inner perimeter of said engaging portion of said frame is slightly smaller than an outer perimeter of said ornamental object, thereby enabling said frame to tightly bind said ornamental object by means of an elasticity of said frame.

2. The display frame of claim 1 wherein:

said frame is adapted to receive a flange of said ornamental object.

* * * * *